United States Patent [19]

Goldfarb et al.

[11] 3,947,031

[45] Mar. 30, 1976

[54] COMPETITIVE TOY BASKETBALL GAME

[76] Inventors: Adolph E. Goldfarb, 4614 Monarca Drive, Tarzana, Calif. 91356; Erwin Benkoe, 17965 Medley Drive, Encino, Calif. 91316

[22] Filed: Feb. 10, 1975

[21] Appl. No.: 548,886

[52] U.S. Cl. ..... 273/85 C; 273/85 E

[51] Int. Cl.[2] ..... A63F 7/06

[58] Field of Search ..... 273/85, 94 R, 101, 95 R, 273/106 B, 126 R, 129

[56] References Cited

UNITED STATES PATENTS

| | | | |
|---|---|---|---|
| 2,711,900 | 6/1955 | Tressler | 273/126 R |
| 3,416,799 | 12/1968 | Lopez | 273/85 D |
| 3,642,280 | 2/1972 | Llorens | 273/85 C |

FOREIGN PATENTS OR APPLICATIONS

| | | | |
|---|---|---|---|
| 1,107,449 | 3/1968 | United Kingdom | 273/85 C |
| 1,450,732 | 7/1966 | France | 273/85 E |

*Primary Examiner*—Anton O. Oechsle
*Assistant Examiner*—Harry G. Strappello
*Attorney, Agent, or Firm*—Robert M. Ashen; Robert J. Schaap

[57] ABSTRACT

A competitive athletic toy game, such as a basketball game, comprising a vertical construction having at least two articulatable player-figures located between two partially transparent walls which also restrain the movement of a playing piece in the form of a disc between the two walls. In the case of a basketball game, this disc would serve as a basketball. Each player of the toy game can control one or more of its own player-figures by means of external levers on opposite sides of the vertical construction. These levers manipulate the player-figures to shoot or to block the disc from entering the opponent's goal area.

12 Claims, 9 Drawing Figures

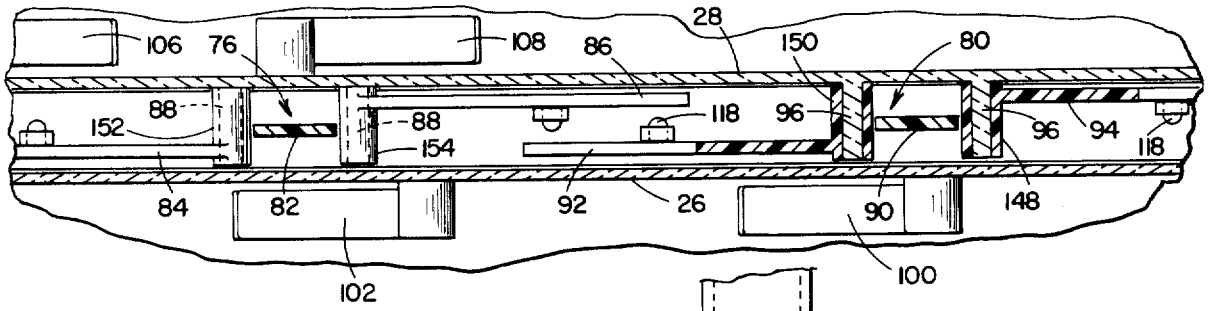
FIG. 4
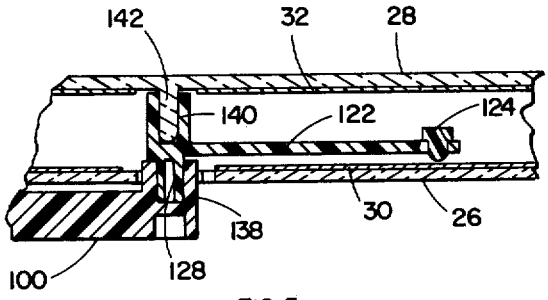
FIG. 5
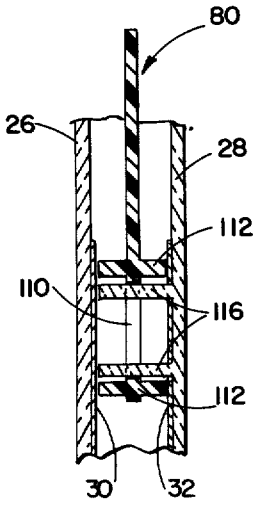
FIG. 6
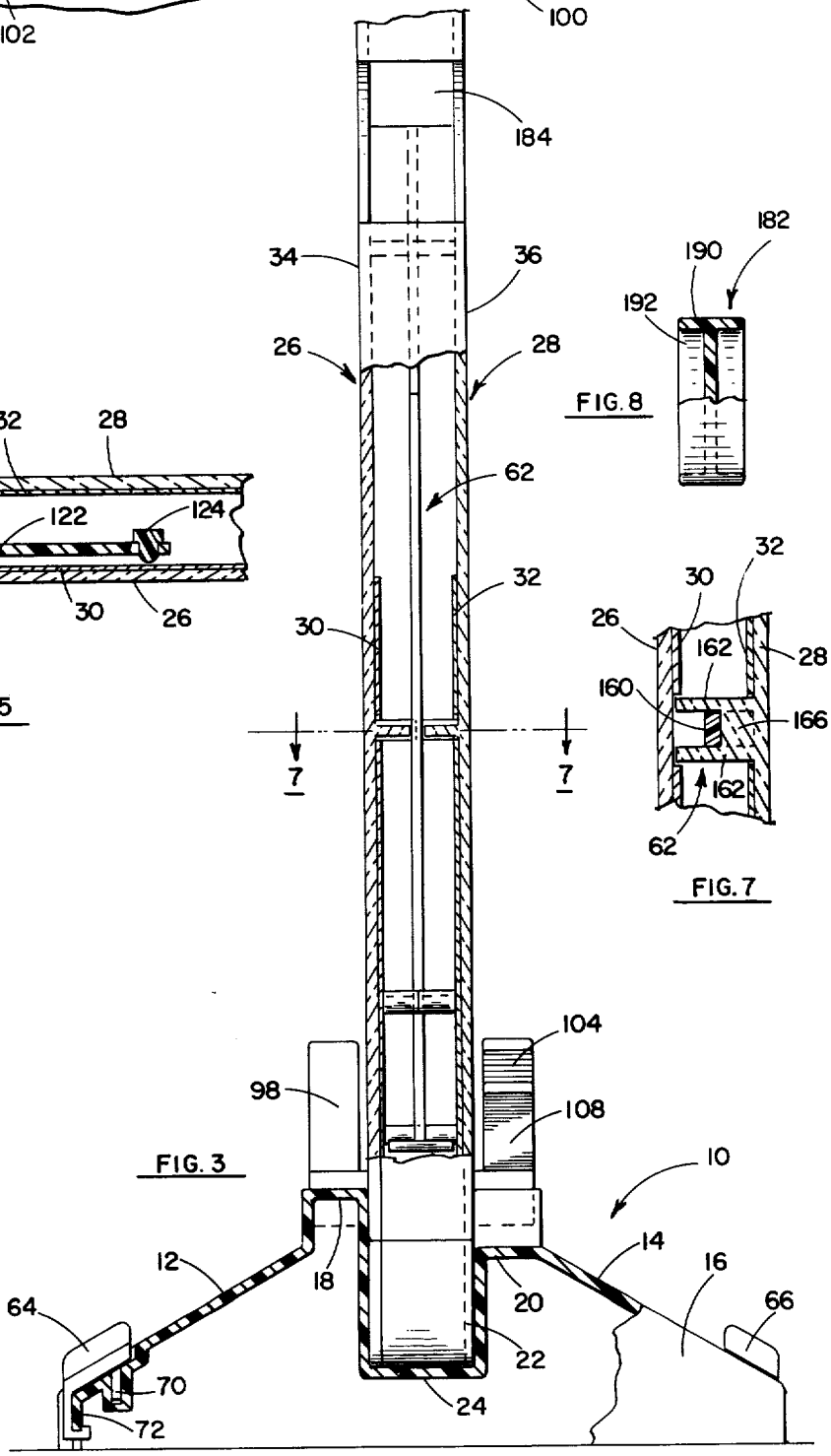
FIG. 3
FIG. 8
FIG. 7

COMPETITIVE TOY BASKETBALL GAME

This invention relates in general to certain new and useful improvements in toy playing games involving player-figures and with a movable disc and, more particularly, to toy playing games where the players of the game can manipulate the player-figures to create movement of a playing piece.

There are a number of commercially available toy playing games which involve a variety of sports activities and in which two or more opponent players will attempt to manipulate a movable playing piece, such as a basketball or the like. These games are usually large in size and, consequently, due to their bulk and weight, they are difficult to store and transport.

Notwithstanding, these various commercially available playing games are quite expensive due to the number of movable components which enable movement of the playing piece and character-figures within the game. Consequently, such games have not always received the wide commercial acceptance which would have otherwise been available if the game had been produced and marketed at a lower price.

There have also been a number of smaller athletic type playing games which have been commercially offered and which games utilize articulatable character figures for shifting a playing piece. However, again, these playing games also include a relatively large number of movable components which are required to create the necessary movable functions of the character-figures, and which, therefore, substantially increases the overall cost of such game.

The present invention obviates these and other problems in the provision of a toy playing game which includes a pair of spaced apart and parallel plates, which are at least partially transparent along their upper portions. The two plates are secured together and retain at least the head and shoulder portion of player-figures which may be movable and in some cases the player-figures have articulatable components, e.g. movable arms on the player-figures. Moreover, along the opposed ends of the two vertical plates, goals are provided for each of the opponent players. Each opponent player generally has one goal attendant player-figure which is a vertically shiftable player, and each of the opponent players has at least one other player-figure which has articulatable components. The opponent players are each provided with levers on opposite sides of the game to control the movements of their own player-figures. In this way, the game can be played with elements of skill and strategy, as well as an element of chance.

It is, therefore, the primary object of the present invention to provide a toy playing game in which two opponent players can manipulate player-figures to thereby shift a playing piece to a desired goal area.

It is another object of the present invention to provide a toy playing game of the type stated which can adopt any of a wide number of athletic game forms which use a movable playing piece to be delivered to an opponent's goal area.

It is a further object of the present invention to provide a toy playing game of the type stated which can be constructed with a minimum number of movable parts and which can therefore be produced at a relatively low unit price.

It is another salient object of the present invention to provide a toy playing game of the type stated which can be manufactured from synthetic resinous materials to provide a highly durable and aesthetically pleasing game.

It is also an object of the present invention to provide a toy playing game of the type stated which permits the opponent players to exercise skill and elements of strategy and which also involves an element of chance.

With the above and other objects in view, our invention resides in the novel features of form, construction, arrangement and combination of parts presently described and pointed out in the claims.

Having thus described the invention in general terms, reference will now be made to the accompanying drawings in which:

FIG. 3 is a fragmentary vertical sectional view taken along line 3—3 of FIG. 2;

FIG. 4 is a fragmentary horizontal sectional view taken along line 4—4 of FIG. 2;

FIG. 5 is a somewhat horizontal sectional view taken along line 5—5 of FIG. 2;

FIG. 6 is a fragmentary vertical sectional view taken along line 6—6 of FIG. 2;

FIG. 7 is a horizontal fragmentary sectional view taken along line 7—7 of FIG. 3;

FIG. 8 is a side elevational view, partially broken away and in section, of a playing piece which is used with the toy playing game of FIG. 1.

Figure 1:
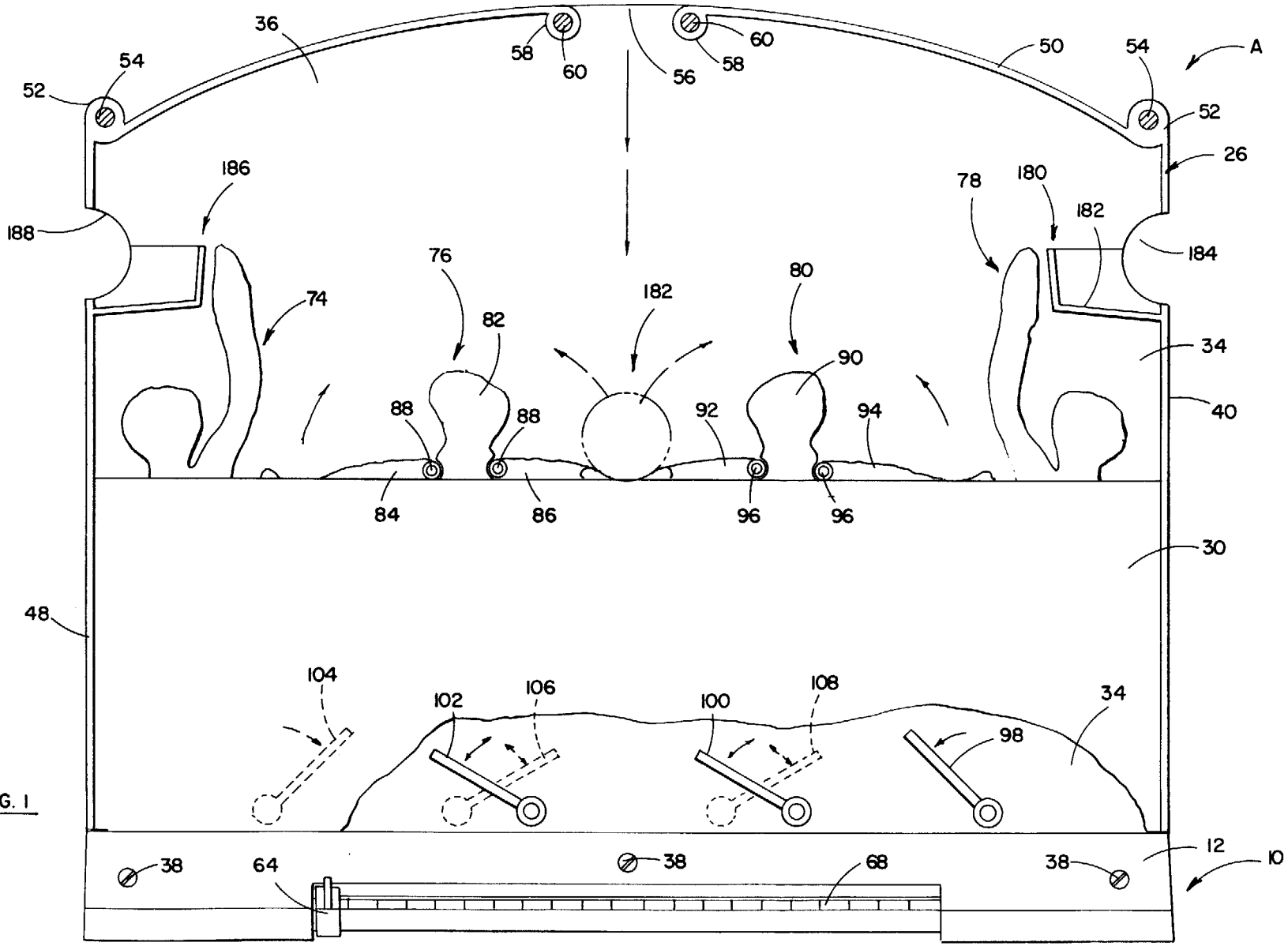
FIG. 1 is a front elevational view, partially shown in dotted lines, of a toy playing game constructed in accordance with and embodying the present invention.

Referring now in more detail and by reference characters to the drawings which illustrate a preferred embodiment of the present invention, A designates a toy playing game of the type described and which can be played by two or more opponent players. In this case, the playing game A can adopt a variety of athletic game forms, as for example basketball, hockey, soccer, football, or the like. The various game forms could be easily implemented by changing the position of the characters in the game or by chamging their overall appearance, or both, or as well as by creating slightly different movements thereof, but which would nevertheless be encompassed by the present invention. However, for purposes of more fully describing the present invention, the game A will be described as a basketball game.

The toy playing game A generally comprises a somewhat trapezoidally shaped base 10, as more fully illustrated in FIG. 3 of the drawings, and which includes a pair of outwardly diverging, and downwardly extending base walls 12 and 14, which are connected at their opposite ends by means of side walls 16. The base walls 12 and 14 integrally merge ito top walls 18 and 20 which, in turn, integrally form a downwardly projected recess 22 having a base supporting wall 24.

Located within the recess 22 is a pair of upstanding front and rear plates 26 and 28, which is also more fully illustrated in FIG. 3 of the drawings. The plates 26 and 28 are spaced apart from each other in the transverse direction and are also parellel to each other. Moreover, the plates 26 and 28 are provided with opaque liners 30 and 32 on the interior surfaces thereof and which extend for approximately one-half the vertical dimension of the plates 26 and 28, to thereby render the lower half of each of the plates 26 and 28 opaque to the interior thereof. The upper portion of the plates 26 and 28 are not covered by the opaque liners 30 and 32 define transparent sections 34 and 36 respectively.

The two plates 26 and 28 are secured to the base 10 by means of a plurality of longitudinally spaced transversely extending pins 38. Moreover, end walls 40 and 42 connect the two plates 26 and 28 along their end margins and furthermore a top wall 50, which is somewhat arcuately shaped, extends across the upper margins of the plates 26 and 28, in the manner as illustrated in FIG. 1 of the drawings. In addition, the top walls are provided with enlarged bosses 52 at each of their opposite ends and which accommodate spacing and securement pins 54. In addition, the top wall 50 is provided with an elongated disc receiving aperture 56, and located at each of the ends of the aperture are bosses 58 which similarly accommodate spacing pins 60. These spacing pins 60, as well as the spacing pins 54, not only serve to hold the two plates 26 and 28 together, but also maintain these plates in spaced apart relationship in order to create an interior chamber 62 therebetween.

Located on each of the base walls 12 and 14 are individual sliders 64 and 66, one of which is more fully illustrated in detail in FIG. 3 of the drawings. These sliders 64 and 66 essentially serve as scorekeepers and operate in conjunction with score depicting elements 68 imprinted, or otherwise located, on the upper surfaces of each of the base walls 12 and 14 in relationship to the sliders 64 and 66. Each of the sliders 64 and 66 include downwardly depending legs 70 which extend within recesses 72 formed within the base walls 12 and 14. In this way, each opponent player may keep the score that he, or otherwise the opponent, generates.

As indicated above, two or more opponent players may play the playing game of the present invention, and one player will have manual control over one character-figure in the form of a goalkeeper 74, as well as manual control over another character-figure in that player's court which is oftentimes referred to as a field player 76. In like manner, the opponent player of the game will have control over a character-figure 78 which serves as this latter opponent player's goalkeeper and one other character-figure in this opponent player's court, often referred to as a field player character-figure 80. These character-figures are oftentimes hereinafter referred to as "player-figures".

The field player-figure 76 is provided with an upstanding head section 82 and a pair of articulatable arms 84 and 86, which are pivoted to the shoulder section of the player-figure 76 by means of pivot pins 88. In like manner, the player character-figure 80 is similarly provided with a head section 90 and a pair of articulatable arms 92 and 94 which are mounted to the shoulder portion of the head section 90 through pivot pins 96.

The first opponent player can control the goalkeeper player-figure 78 by means of a manually operable lever 98 which is mounted on the plate 26 and each of the arms 92 and 94 through manually operable levers 100 and 102, also mounted on the front plate 26. The other opponent player can control the movement of the goalkeeper player-figure 74 through a manually operable lever 104 which is mounted on the plate 28. The arms 84 and 86 of the field player-character-figure 76 can be controlled by means of manually operable levers 106 and 108, respectively, which are also pivotally mounted on the plate 28. The actual mechanism for controlling the various character player-figures through the aforementioned manually operable levers is more fully described in detail hereinafter.

Figure 2:
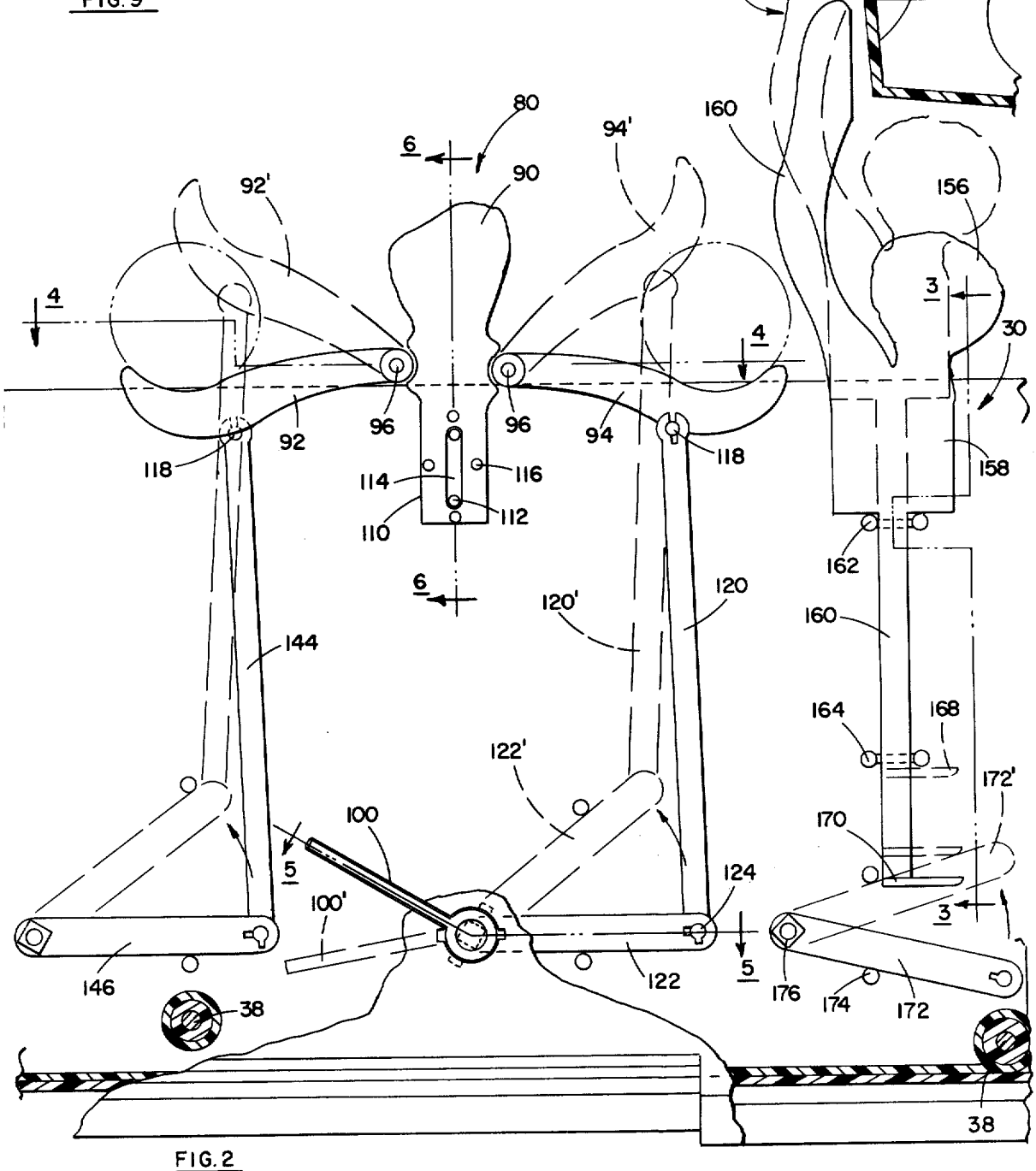
FIG. 2 is a fragmentary vertical sectional view, partially shown in phantom lines, substantially taken along the plane of FIG. 1, and showing the interior components of the toy playing game.

The actual mounting of the character-figure 80 within the central receiving recess 62 and the mechanism for shifting the articulatable arms 92 and 94 of this character-figure is more fully illustrated in FIG. 2 of the drawings. It can be observed that the head section 80 includes a downwardly extending mounting flange 110 which is located in the area of the opaque liners 30 and 32. The head section 80 is retained in place by means of a pair of locking pins 112 which extend between the two plates 26 and 28 and are located in an elongated positioning slot 114 formed within the flange 110. In addition, four quadrilaterally located spacer pins 116 also extend through the depending flange 110 and are secured to plates 26 and 28 and the associated liners 30 and 32, as more fully illustrated in FIGS. 2 and 6 of the drawings. Again, the spacer pins are designed to maintain the desired spatial separation between the two plates 26 and 28 and thereby insure overall dimensional accuracy of the interior chamber 62.

By reference to FIGS. 2, 4 and 5, it can be observed that the arm 94 is provided with a locking pin 118 which is engageable with the bifurcated end of a vertically disposed link 120. The link 120 is, in turn, pivotally connected to an actuating link 122 through a locking pin 124. Finally, the actuating link 122 is connected to and movable with the lever 100 in a manner which is more fully illustrated in FIG. 9 of the drawings. It can be observed that the pin 124 of the vertical link 120 extends through a locking aperture 126 formed in the outer end of the actuating link 122. The other end of the actuating link 122 is provided with a rectangularly shaped boss 128 which fits within a like shaped aperture (not shown) on a hub 130 which is integrally formed on the end of the lever 100. In addition, the actuating link 122 is provided on the opposite side of the boss 128 with a cylindrically shaped sleeve 140 which is recessed to accommodate a pin 142 projecting from the plate 28 in the manner as illustrated in FIG. 5 of the drawings.

It can be observed and understood from the above-outlined construction, that the linkage including the links 120 and 122 is only supported at the arm 94 and at the connection of the lever 100. Thus, when the lever 100 is shifted downwardly, under manual action, to a lever position 100', as illustrated in the phantom lines of FIG. 2, the actuating link 122 will shift to the position where it is illustrated in the phantom lines of FIG. 2 and is designated by 122'. In like manner, the vertical link 120 will shift to the position as illustrated in the phantom lines and designated by reference numeral 120'. Finally, the arm 94 will shift upwardly, as illustrated in the phantom lines of Figure and as designated by reference numeral 94'. It also can be observed that the arm 94 will remain in the upper position 94' as long as the lever 100 is held in the lever position 100'.

The arm 92 is similarly connected through a vertical link 144 and a horizontally disposed actuating link 146 to the lever 102 in the same manner as the arm 94 was connected to the lever 100. It can also be observed that the arm 92 can be shifted to the upper position, as illustrated in the phantom lines of FIG. 2 and as designated by reference numeral 92', when the lever 102 is shifted downwardly under manual actuation. Again, it should be observed that the arm 92 will remain in the upper position 92' as long as the lever 102 is pushed downwardly. It can also be observed that both of the arms 92 and 94 will fall to the lower or unactuated position when not pressed and the levers 100 and 102 will be biased upwardly to the position as shown in the solid lines of FIGS. 1 and 2 due to the weight of the arms 92 and 94 exerted through the linkages 102 and 122 and the linkages 142 and 146.

It should be understood that the arms 84 and 86 of the character-figure 76 are operated in like manner by respectively actuating the levers 104 and 106. Again, these levers 104 and 106 are respectively connected to the arms 84 and 86 by means of a similar form of linkage and which is also illustrated in FIG. 4 of the drawings. Inasmuch as this linkage is identical to that previously described, the linkages actuating the arms 84 and 86 with respect to the levers 104 and 106 respectively are neither illustrated nor described in any further detail herein.

By further reference to FIG. 4, it can be observed that the arms 94 and 96 are provided with sleeves 148 and 150 in order to accommodate the pins 96 which are integral with the plate 28 and extend through the respective sleeves 148 and 150 in order to engage the plate 26. In this way, the spatial relationship of the plates 26 and 28 is thereby further maintained. In addition, it can be observed that the arms 84 and 86 are similarly provided with sleeves 152 and 154, respectively, in order to accommodate the pins 88, which in this case are integral with the plate 26.

The construction and operation of one of the goalkeeper character-figures 78 is more fully illustrated in FIGS. 2, 3 and 7 of the drawings. In this case, it can be observed that the goalkeeper FIG. 78 is provided with an enlarged head 156 having a depending body flange 158 integral therewith and which extends beneath the opaque liners 30 and 32. In addition, the character-figure 78 is provided with an upwardly projecting blocking arm 160 and which extends above the opaque liners 30 and 32.

Extending downwardly from the body flange 158 is an elongated vertically disposed arm 160 which is retained between an upper pair of guides 162 and which extend between the two plates 26 and 28. In like manner, a pair of lower guides 164 also retain the arm 160 in its vertical position and, in like manner, the guides 164 will also extend between the two plates 26 and 28. In addition, one of the plates 28 is integrally provided with an inwardly extending web 166, as more fully illustrated in FIG. 7, and which engages the arm 160 in order to further maintain spatial relationship of the arm 160 with respect to the two plates 26 and 28, as well as to maintain the spatial relationship between the plates 26 and 28. Also carrried by the arm 160 beneath the lower set of guide pins 164 is a limit flange 168 which controls the upper limit of movement of the arm 160 and hence the upper limit of movement of the character-figure 78. It can be observed that this flange 168 will abut against the lower guide pins 164 in order to limit the upward movement of the character-figure 78.

Figure 9:
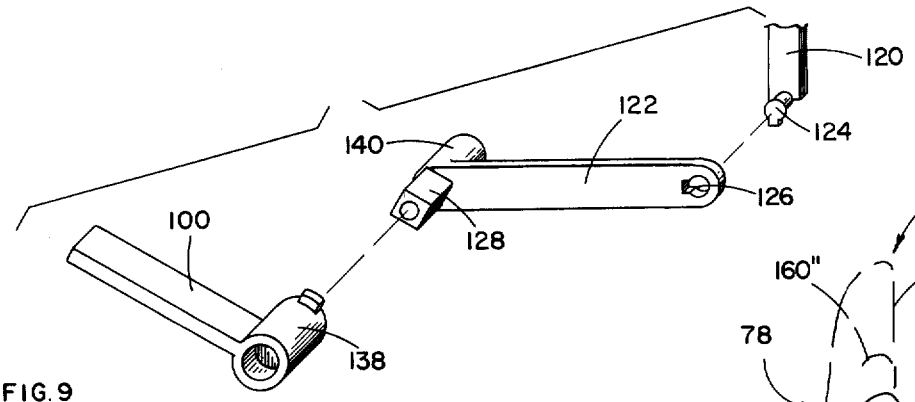
FIG. 9 is an exploded perspective view showing a portion of the linkage mechanism which operates the player-figures by means of external levers.

Fixedly secured to the lower end of the arm 160 is a foot 170 which bears against an actuating link 172. The lowermost movement of the actuating link 172 is limited by means of a stop pin 174. The left-hand end of the link 172, reference being made to FIG. 2, is also provided with a rectangularly shaped outwardly extending hub 176 which engages the lever 98 in the same manner as the actuating link 122 was connected to the lever 100 and as illustrated in FIG. 9 of the drawings. In the case of the lever 100 and the characterization FIG. 78, no vertical link is required for the operation of this characterization figure, as hereinafter described. The characterization FIG. 74 is similar in construction to that of the characterization FIG. 78 and operates in like manner.

When it is desired to operate the goalkeeper characterization FIG. 78, the player opponent will press downwardly on the lever 98 with a rather quick snap-type action which will cause the characterization FIG. 78 to literally jump upwardly to a position where it is illustrated in the phantom lines designated by reference numeral 78' and where the arm shifts upwardly to the position as designated by reference numeral 160'. In this way, it can be observed that the goalkeeper characterization FIG. 78 can block a goal 180. However, it can also be observed that the opponent player cannot continuously hold the characterization FIG. 78 in the uppermost position as designated by 78' inasmuch as the uppermost limit of movement of the link 172 is designated by reference numeral 172'.

By merely pushing the lever 172 to its uppermost limit of movement as represented by reference numeral 172', the arm 160 will only shift to the position as designated by reference numeral 160'' in FIG. 2 of the drawings. In this case, it can be observed that the arm 160 is not sufficiently high to block the goal 180. Hence, the opponent player cannot continuously block the goal, but whenever the playing piece in the form of a puck or disc 182 is directed toward the goal 180, then the opponent player can merely actuate the lever 98 with a snap-type action in order to raise the blocking arm 160 to the position as designated by 160'.

The goal 180 is formed with a rectangularly shaped trough 182 which opens through an enlarged slot 184 formed in the end wall 40. In like manner, a similar goal 186 is provided on the opposite end wall 48 and is identical in construction to the goal 180. This goal 186 also opens through an arcuately shaped aperture 188 in the end wall 48.

The disc 182 which is used as the playing piece in the present invention is more fully illustrated in FIG. 8 of the drawings and in this case would actually serve as a basketball. Again, it can be observed by reference to FIGS. 7 and 8 that the disc is sized to fit within the elongated chamber 62, but is only provided with a slight amount of clearance. The disc in this case comprises an outer cylindrical wall 190, which is connected by an interior web 192.

It can be observed that the various articulatable arms on the characterization figures are thinner in cross section than the disc 182. Moreover, it can also be observed that the outermost arms 84 and 94 on the two characterization FIGS. 76 and 80, respectively, are located adjacent to the fixed upstanding locking arms of the characterization FIGS. 74 and 78. In addition, it can be seen that the two adjacent arms 86 and 92 on the characterization FIGS. 76 and 80 are also located in almost abutting relationship. Consequently, the disc 182 cannot pass into the lower portion of the chamber 62. This holds true even when the two arms 86 and 92 are shifted to their uppermost position. In addition and inasmuch as the disc 182 is almost of the same cross-sectional thickness as the chamber 62, it cannot be dislodged.

When playing the game, such as a game of basketball, as in this case, the two opposing players position themselves on opposite sides of the two plates 26 and 28. To start the game, one of the opposing players will drop the disc or so-called "ball" 182 through the aperture 56 on the top wall 60. It can be observed that the disc 182 will land between the two arms 86 and 92 of the characterization FIGS. 76 and 80. Each one of the players will attempt to shift the ball to its court. Thus, one of the opposing players actuating the lever 108 will attempt to shift the arm 86 upwardly and thereby shift the disc 182 toward the goal 186, or so-called "basket". In like manner, the other opposing player will attempt to actuate the lever 102 to urge the articulatable arm 92 upwardly and shift the disc 182 toward its basket 180. Once the ball is in play, it can be shifted back and forth. Each opposing player will attempt to block any movement of the disc 182 toward its goal by actuating the goalkeepers 74 or 78. As indicated above, this blocking action can only be conducted by pressing down on the lever arms 104 or 98 with a snap-type action in order to cause the characterization FIGS. 74 and 78 to "jump", but cannot continuously block the two goals 180 and 186.

The opaque liners 30 and 32 could also have aesthetic images presented thereon so as to complete the characterization figures and thereby present bodies to the various characterization figures. In the case of the embodiment where the game is a basketball game, these characterization figures could have depictions of basketball game clothing.

The various components of the playing game described herein can be conveniently formed of any of a number of known plastic materials, including polyethylene, polystyrene, polybutadiene, any of a number of the vinylidene copolymers, etc. Moreover, these various components can be formed by any of a number of known plastic forming operations, including injection molding, thermo-forming, blow molding, and the like. Notwithstanding, some or all of the components of the housing could be made from other materials. As for example, many of the components could be made of lightweight metals, etc. In this way, it can be observed that the playing game A can be constructed at a relatively low unit cost on a mass production basis.

It should be observed that while the present invention has been described in terms of a basketball game, that any of a number of athletic game forms could be constructed in accordance with the present invention. Thus, the game of the present invention could be constructed in the form of a hockey game for example. In this case, the articulatable appendages of the player-figures could be provided with extensions in the form of hockey sticks. In addition, the goals could be substituted by goal areas similar to the goal areas of a normal hockey game. In this same respect, the various goal players could be altered so that they would conform to the normal rules of the game being played in accordance with the construction of the present invention. In addition, the goal areas could represent desired areas for playing piece location, e.g. the end zone in a game of football, for example.

Thus, there has been illustrated and described a unique and novel playing game which permits the opposing players of the game to exercise skill and strategy, as well as playing the game with an element of chance, and which therefore fulfills all of the objects and advantages sought therefor. It should be understood that many changes, modifications, variations and other uses and applications will become apparent to those skilled in the art after considering this specification and the accompanying drawings. Therefore, any and all such changes, modifications, variations, and other uses and applications which do not depart from the nature and spirit of the invention are deemed to be covered by the invention which is limited only by the following claims.

Having thus described our invention, what we desire to claim and secure by Letters Patents is:

1. A competitive playing game where at least one or more players attempt to score by moving a playing piece into a goal area, said game comprising:

a. plate means forming a central chamber therebetween, b. a first goal area located with respect to said central chamber and communicating therewith, c. a playing piece movable in said chamber and capable of being shifted toward said goal area, d. at least one field player-figure in said chamber and having at least one articulatable appendage, e. first namually operable lever means operatively connected to said articulatable appendage for moving same, f. at least one first individual goal player-figure located in relationship to said first goal area, g. second manually operable lever means operatively engageable with said first goal player-figure for causing said first goal player-figure to jump into goal blocking relationship to said first goal area, said second lever means not being mechanically physically attached to said first goal player-figure.

2. The competitive playing game of claim 1 further comprising a second goal area, a second individual goal player-figure located in relation to the second goal area, and a third manually operable lever operatively engageable with said second goal player-figure for causing said second goal player-figure to jump into goal blocking relationship, said third lever means not being mechanically physically attached to said second goal player-figure.

3. The competitive playing game of claim 2 further characterized in that said first and second goal character figures being capable of being shifted upwardly by simple actuation of said respective second and third lever means, but not being shiftable to goal blocking position, guide means retaining each said first and second goal character figures and said goal character figures being capable of being shifted to goal blocking positions only momentarily by actuating said respective second and third lever means with a manual snap-type action to cause said respective first and second goal character figures to jump in said guide means.

4. The competitive playing game of claim 2 further characterized in that an individual guide means is provided for each of said first and second goal character figures.

5. The competitive playing game of claim 2 further characterized in that said second and third lever means are movable from first rest positions to second actuated positions and when in said second actuating position, said respective first and second goal character figures can be operatively supported but will not be shifted to goal blocking position, said first and second goal character figures only being shiftable to goal blocking position by actuating said second and third lever means with a snap-type action.

6. The competitive playing game of claim 1 further characterized in that said field player figure is provided with a second articulatable appendage, and additional manually operable lever means is provided and operatively connected to said second articulatable appendage and operates same.

7. The competitive playing game of claim 2 further characterized in that said game comprises a second field player having at least one articulatable appendage, and further manually operable lever means is provided and operatively connected to said articulatable appendage of said second field player-figure.

8. The competitive playing game of claim 7 further characterized in that each of said first and second field player figures have one of their respective appendages located so that said playing piece cannot drop below said appendages, whether or not actuated, and said figures having the other of their respective appendages operatively located with respect to the goal area so that said playing piece cannot drop below said appendages.

9. The competitive playing game of claim 1 further characterized in that said field player-figure is provided with a second articulatable appendage, and additional manually operable lever means is provided and operatively connected to said second articulatable appendage and operates same, and a second field player-figure having at least one articulatable appendage, and further manually operable lever means is provided and operatively connected to said articulatable appendage of said second field player-figure.

10. The competitive playing game of claim 1 further characterized in that said appendages on each of said field playing figures are representative of arms.

11. A competitive playing game where at least two or more opposing players attempt to score by moving a playing piece into an opponent player's goal area, said game comprising:

a. a pair of opposed plate means forming a chamber therebetween, said plate means being at least partially transparent to render at least a portion of said chamber visible to a viewer, b. at least one first playing figure having at least a movable portion, c. a playing piece introduceable in said chamber and being shiftable therein but restrained against movement in at least one plane by said pair of opposed plate means defining said chamber, d. first manually operable actuating means located with respect to an exterior surface of one of said plate means and being operable by a first opposing player for shifting said movable portion of said first figure to thereby move said playing piece, e. at least one second playing figure having at least a movable portion, f. second manually operable actuating means located with respect to an exterior surface of the other of said plate means and being operable by a second opposing player for shifting said movable portion of said second playing figure to thereby move said playing piece, and g. a pair of opposed goal defining means operatively communicating with said chamber for receiving said playing piece upon movement thereof, the movable portions of each of said first and second playing figures being a pair of spaced apart articulatable appendages on each such playing figure, and a separate actuating means for operating each of said pair of spaced apart appendages on each figure, each of said first and second figures having one of their respective appendages located so that said playing piece cannot drop below said appendages, whether or not actuated, and said figures having the other of their respective appendages operatively located with respect to the goal defining means so that said playing piece cannot drop below said appendages.

12. A competitive playing game where at least two or more opposing players attempt to score by moving a playing piece into an opponent player's goal area, said game comprising:

a. a pair of opposed plate means forming a chamber therebetween, said plate means being at least partially transparent to render at least a portion of said chamber visible to a viewer, b. at least one first playing figure having at least a movable portion, c. a playing piece introduceable in said chamber and being shiftable therein but restrained against movement in at least one plane by said pair of opposed plate means defining said chamber, d. first manually operable actuating means located with respect to an exterior surface of one of said plate means and being operable by a first opposing player for shifting said movable portion of said first figure to thereby move said playing piece, e. at least one second playing figure having at least a movable portion, f. second manually operable actuating means located with respect to an exterior surface of the other of said plate means and being operable by a second opposing player for shifting said movable portion of said second playing figure to thereby move said playing piece, and g. a pair of opposed goal defining means operatively communicating with said chamber for receiving said playing piece upon movement thereof, said plate means comprising a pair of spaced apart plates which define a chamber therebetween of substantially uniform cross section, a lowermost portion of each of said plates being opaque, and an uppermost portion of each of said plates being transparent so that said opposing players can view movement of said playing piece.

* * * * *